United States Patent [19]

Chartier et al.

[11] Patent Number: 4,585,198

[45] Date of Patent: Apr. 29, 1986

[54] ANCHORING SYSTEM

[75] Inventors: Guy N. Chartier, West Hill; John T. Wickmann, Omemee, both of Canada

[73] Assignee: Chart Industries Limited, Pickering, Canada

[21] Appl. No.: 529,034

[22] Filed: Sep. 2, 1983

[30] Foreign Application Priority Data

Sep. 13, 1982 [CA] Canada ..... 411298

[51] Int. Cl.[4] ..... B21D 1/12

[52] U.S. Cl. ..... 248/352; 187/8.43; 72/705

[58] Field of Search ..... 248/352, 500, 503, 352; 52/DIG. 11, DIG. 3, 23, 704; 72/705, 704; 187/8.43, 8.45, 8.74; 254/2 C

[56] References Cited

U.S. PATENT DOCUMENTS

| | | | |
|---|---|---|---|
| 3,612,287 | 10/1971 | Maltese | 52/704 |
| 3,787,024 | 1/1974 | Dzus | 248/503 |
| 3,828,491 | 8/1974 | Koon | 52/DIG. 11 |
| 3,990,207 | 11/1976 | Eck | 52/704 |
| 4,125,975 | 11/1978 | Soble | 52/DIG. 11 |
| 4,236,400 | 12/1980 | Spector | 72/705 |
| 4,337,636 | 7/1982 | Clausen | 72/705 |
| 4,400,969 | 8/1983 | Spector | 72/705 |

FOREIGN PATENT DOCUMENTS

| | | | |
|---|---|---|---|
| 125435 | 3/1974 | Japan | 72/705 |
| 1181040 | 2/1970 | United Kingdom | 72/705 |

OTHER PUBLICATIONS

Sun, Collision Repair System, publication, 9-1980.

*Primary Examiner*—Reinaldo P. Machado
*Assistant Examiner*—Alvin Chin-Shue
*Attorney, Agent, or Firm*—Weingarten, Schurgin, Gagnebin & Hayes

[57] ABSTRACT

The present invention relates to an anchoring system and apparatus for positively anchoring a vehicle with respect to a base. The anchoring system includes three or more rigid anchoring apparatus which grasp the pinchwelds of the vehicle to support the vehicle above the base. The apparatus are provided with clamps to secure the support members to the base. The base may be an elevated platform, elevated rails or a concrete floor. The present invention further provides a novel anchoring device insertable into a concrete floor which anchors a rigid anchoring member. The anchoring device cooperates with the clamps and anchoring member to positively anchor the anchoring apparatus to the concrete floor.

18 Claims, 13 Drawing Figures

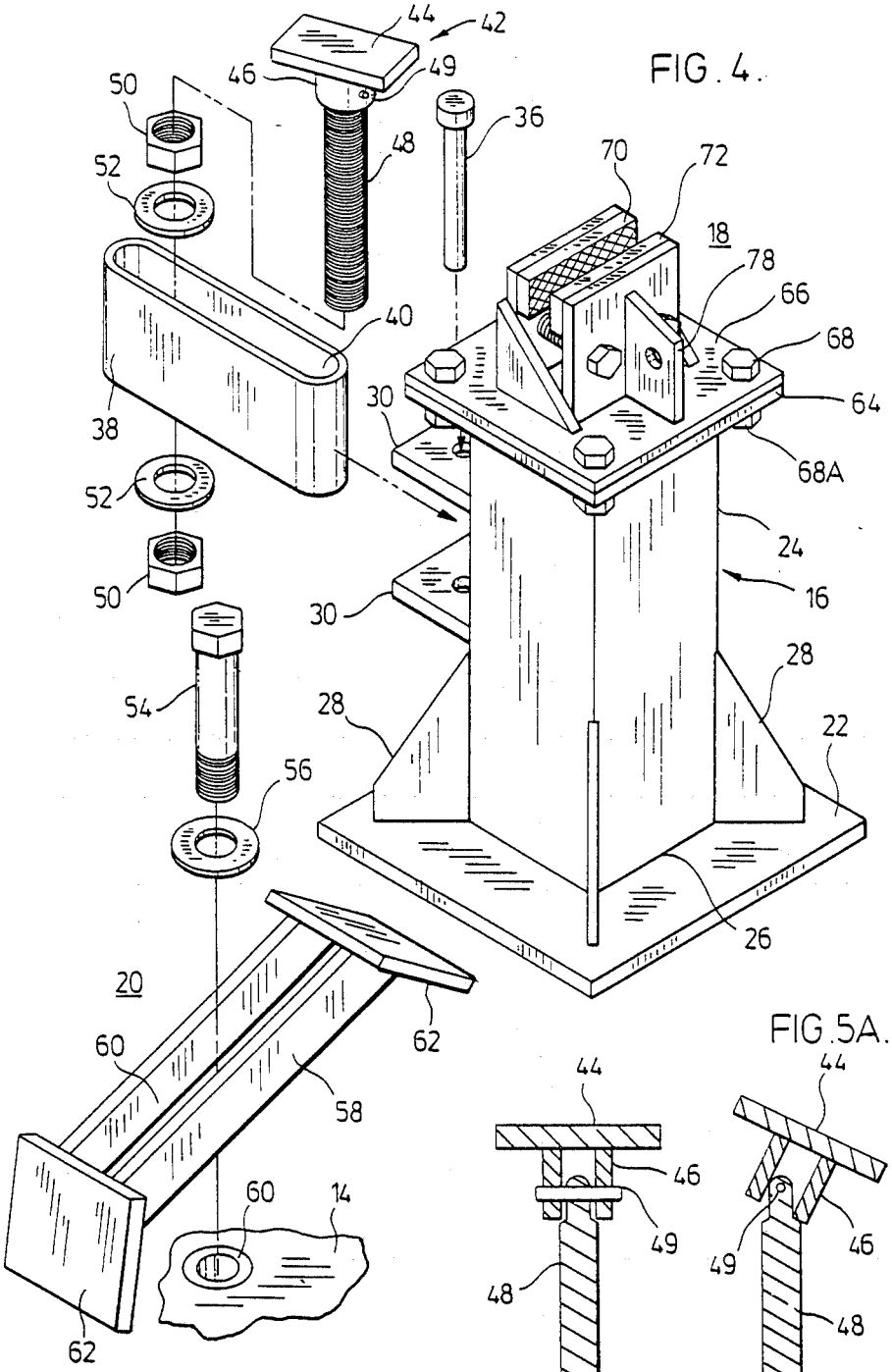
FIG. 4.
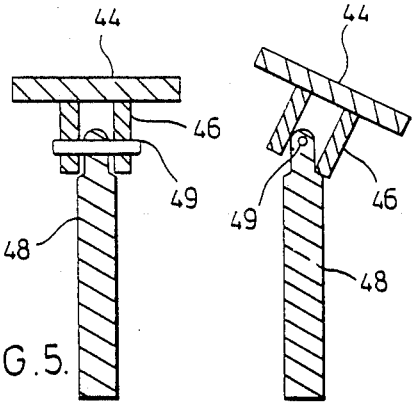
FIG. 5A.
FIG. 5.

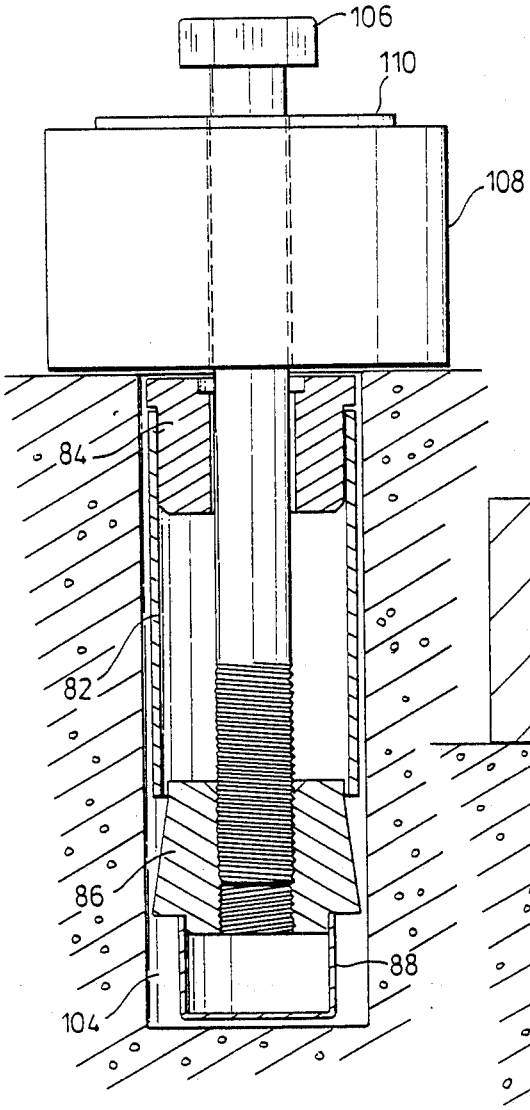
FIG. 11.
FIG. 12.
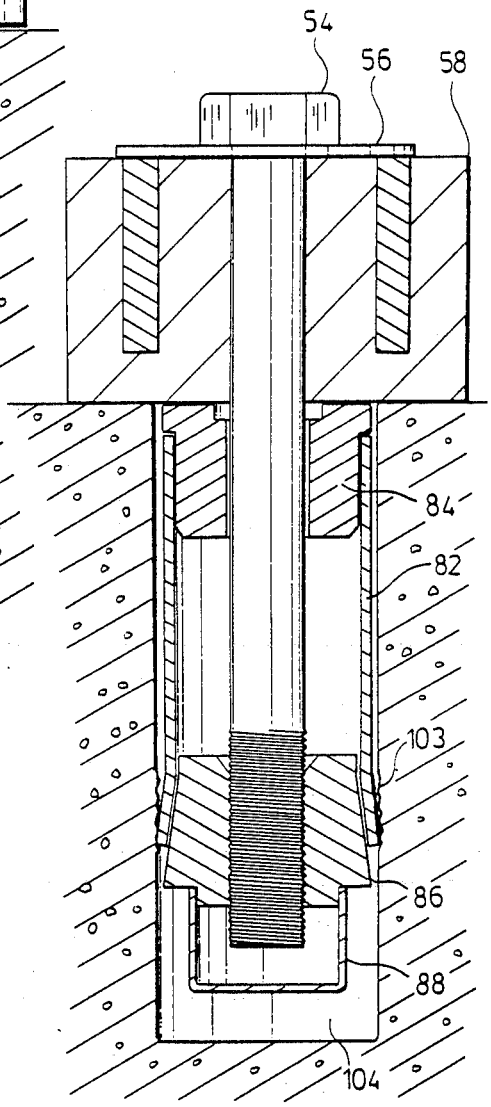

ANCHORING SYSTEM

The present invention relates to an anchoring system which positively locates a vehicle relative to a base such that the vehicle is held in position during the realignment or repair to the body structure of the vehicle.

During the repair of automobile bodies, frames or panels, considerable forces are applied by powered machine tools in a sequence of controlled pulls to reverse the steps in which the damage occurred until the body, suspension mounts and underlying structure conform to original factory specifications.

Prior to effecting any sequence of controlled pulls on the automobile it is necessary that the automobile be anchored with respect to a base such as a concrete floor, or an elevated rack or rail system.

At present, there are many methods in which the automobile is anchored with respect to the base. One method involves chains secured to the underside of an automobile, usually the frame. The chain is drawn taut by a turn buckle or other adjustable means to prevent movement of the vehicle in a direction along the length of the chain. Such an anchoring system does not prevent movement of the automobile relative the base during the controlled pull, however. Further, during the repair of the automobile, as the pulling towers are moved about the automobile to provide the sequence of controlled pulls, the securing chains may have to be altered in order to maintain the automobile fixed relative to the pulling forces. Another method involves using four adjustable support stands which are free to pivot with respect to their base. Each stand is provided with jaws which secure the automobile to the stand. During the repair of the automobile, however, the automobile tends to move slightly on the four pivot points provided by the stands. As a result, additional securing means such as chains may have to be used.

These anchoring systems, however, are not well suited for use with an automobile having a unitized body because as the automobile shifts relative to the base during a pull, the points of reference for a gauging system are lost introducing inaccuracies into the repair of the automobile.

In a chain anchoring system, the chain may be readily secured to a rack or rail, however, an anchoring device is required when the chain is to be anchored to a concrete floor. The anchoring device is basically a cylinder which is inserted into a hole in the concrete. When the chain is not in use, it may be stored in the cylinder. When the chain is to be used, it may be drawn up out of the cylinder. The end of the chain is secured in the cylinder to a disc shaped piston or other apparatus. As the chain is pulled from the cylinder, it draws the piston up against the steel cylinder. The steel cylinder prevents the travel of the piston out of the cylinder thereby holding the end of the chain in the cylinder relative to the concrete floor. The chain used in this anchoring device, however, is flexible and during a pull can pivot about the point where the chain is anchored to the base. This device does not provide a non-moving anchoring point.

It is therefore an object of the present invention to provide an anchoring system and apparatus which positively anchor the vehicle and do not require any additional adjustments once the vehicle is positively located with respect to a base.

It is a further object of the present invention to provide an improved anchoring device for anchoring a rigid anchoring means.

In accordance with one aspect of the present invention there is provided an anchoring device for securing a rigid anchoring means within an aperture of a base. The devide includes a deformable cylinder means and a securing means. The deformable cylinder means is insertable into the base aperture and is open at both ends. One open cylinder end includes a receiving collar for limiting movement of the rigid anchoring means in directions perpendicular to the axis of the cylinder means and for dispersing components of loading forces acting in said directions on the rigid anchoring means. The securing means is securable with the rigid anchoring means for limiting movement of said anchoring means along the cylinder means axis and for displacing the walls of the cylinder means into engagement with the base.

The securing means may include diverging means having an outside dimension that is greater than the opening of the other end of the cylinder means and is not greater than the outside dimension of the cylinder means. The diverging means displaces the outer wall of the cylinder means into engagement with the base when the securing means is drawn up into the other open cylinder end.

It should be understood that the receiving collar and securing means cooperate to limit movement of the rigid anchoring means in all pulling directions. As a result, the rigid anchoring means is positively anchored relative to the base. Furthermore, the receiving collar reduces the risk of the rigid anchoring means breaking because the collar disperses components of the loading forces to the concrete base.

The securing means may have an aperture therein for receiving the rigid anchoring means. In the preferred construction, the rigid anchoring means is a bolt and the securing means comprises a piston having a threaded aperture that threadibly engages the bolt and passes through the piston. In the preferred construction the diverging means of the piston has a continuous and conically shaped outer surface and the piston has a locating flange on the outer side thereof for locating a cylindrical cap that covers the piston aperture and is attached to the securing flange by means of an interference fit. The purpose of this cap is to prevent water from seeping up through the center of the anchoring device.

It is envisaged that the receiving collar may be formed as an integral part of the cylinder means, however, in the preferred embodiment the collar is a separate part that is inserted into the other open cylinder end. The receiving collar is maintained in the cylinder means by an interference fit. The collar has an aperture through which the bolt passes. The bolt is held from movement perpendicular to the axis of the cylinder means by an inner wall of the collar which defines the collar aperture. The inner wall is of a predetermined height so as to adequately disperse the components of the loading forces acting on the bolt. The collar is adapted to lie flush with surface of the base and includes a seat at an outward end of its aperture to receive a plug which is inserted into the aperture when the anchoring device is not in use.

In accordance with another aspect of the present invention there is provided an anchoring apparatus for use in a vehicle anchoring system to positively anchor the vehicle with respect to a base. The apparatus includes a rigid stand means and stand securing means. The rigid stand means has a base member which is adapted to engage the base for dispersing loading forces to the base. The rigid stand means further includes a support member upstanding a predetermined distance from the base member and a vehicle securing means located on the upper end of the support member. The vehicle securing means is adapted to be releasably secured with the vehicle whereby the vehicle is secured to the stand means. The stand securing means is securable with the base member of the stand means and the base so as to positively anchor the stand means on the base whereby the rigid stand means does not move.

By using at least three of the anchoring apparatus, an anchoring system for positively locating the vehicle with respect to the base may be provided for the purposes of realignment and body repair. It may be more advantagrous, however, to use at least four of the anchoring apparatus to more evenly distribute the vehicle lead on the anchoring apparatus. The anchoring apparatus may further be provided with a receiving means such that the anchoring apparatus may be pulled to effect repair to the underside of the vehicle prior to the anchoring apparatus being secured to the base. It should be understood that it may be possible to anchor the vehicle with one anchoring apparatus as long as the vehicle is supported above the ground by some other means such as blocks.

An anchoring system using a plurality of these anchoring apparatus has the advantage that the apparatus do not have to be repositioned with respect to either the vehicle or the base during the repair of the body structure of the automobile. Further, because the vehicle is positively anchored with respect to the base, the points of reference for a gauging system are not disturbed during repair of the vehicle.

Additionally, the anchoring apparatus may include an arm support means moveably connectably with the support member and extending outwardly therefrom. The arm support means may include a body support means adapted to support the underbody of the vehicle. The arm support means is movable horizontally and vertically such that it can be positioned in the direction of the pulling force without having to reposition the anchoring apparatus.

In the preferred embodiment, the arm support means includes an elongated slotted arm having one end thereof pivotally connected to the support member of the stand means. The body support means comprises a support pad mounted to a stem. The stem is slidable horizontally along the arm slot, securable in arm slot and adjustable vertically relative to the arm to bring the pad into engagement with the vehicle. The support pad is pivotally mounted to the stem to allow the support pad to engage parts of the underbody of the vehicle which are not parallel to the base.

In the preferred embodiment, the stand securing means is a clamp bracket that is releasably securable with the stand means and includes an elongated slot through which the anchoring means passes to clamp the ends of the bracket to the base member and base. The anchoring means is slidable along the clamp slot allowing the clamp bracket to be positioned relative to the anchoring means. Thus, some freedom is permitted in choosing where the stand means are to be positioned relative to the base. Further, one end of the clamp bracket is smaller than the other end so as to compensate for the height of the base member above the base. This maintains the clamp bracket perpendicular to the anchoring means.

In the preferred embodiment the vehicle securing means comprises at least one set of clamping jaws which has one jaw movable relative to the other to clamp onto the pinchweld of the vehicle. Alternatively, the vehicle securing means may comprise a clamp such as a U-bolt which clamps onto the frame structure of older model vehicles. In either event, the vehicle securing means is releasably securable with the support stand means to permit the interchangeability of the different types of vehicle securing means.

For a better understanding of the nature and objects of the present invention, reference may be had by way of example to the accompanying diagrammatic drawings for the preferred embodiments of the present invention:

FIG. 4 is an exploded perspective view of the anchoring apparatus of the present invention;

FIGS. 5 and 5A are two different side sectional views illustrating the pivotal connection of the support pad to the stem of the body support means;

FIG. 11 is a side sectional view of the anchoring device of the present invention shown about to be installed in the aperture of the concrete floor by an installation sleeve and bolt; and FIG. 12 is a side sectional view of the anchoring device for the present invention showing the anchoring device installed in the floor and the anchoring means secured within the anchoring device.

Figure 1:
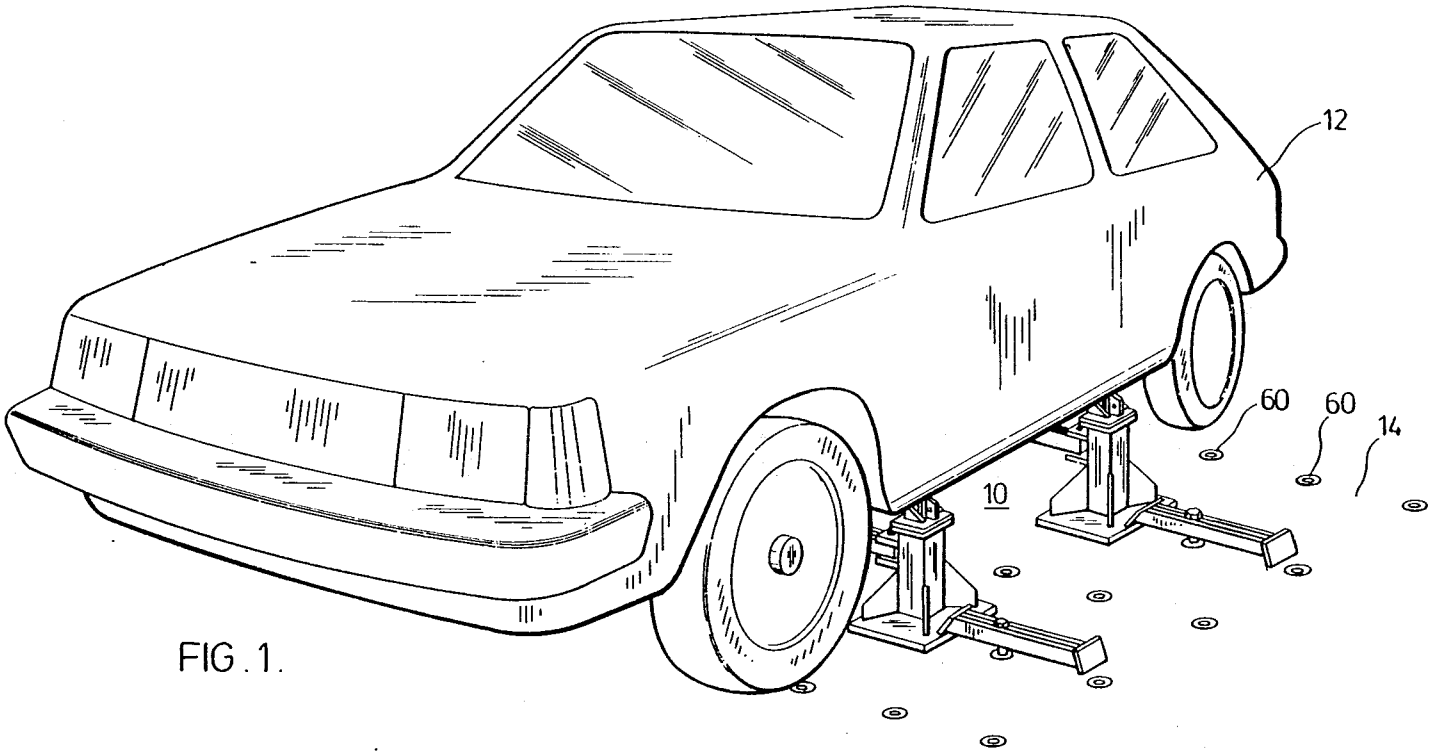
FIG. 1 is a perspective view showing an anchoring system for anchoring a vehicle relative to a concrete floor.
Figure 2:
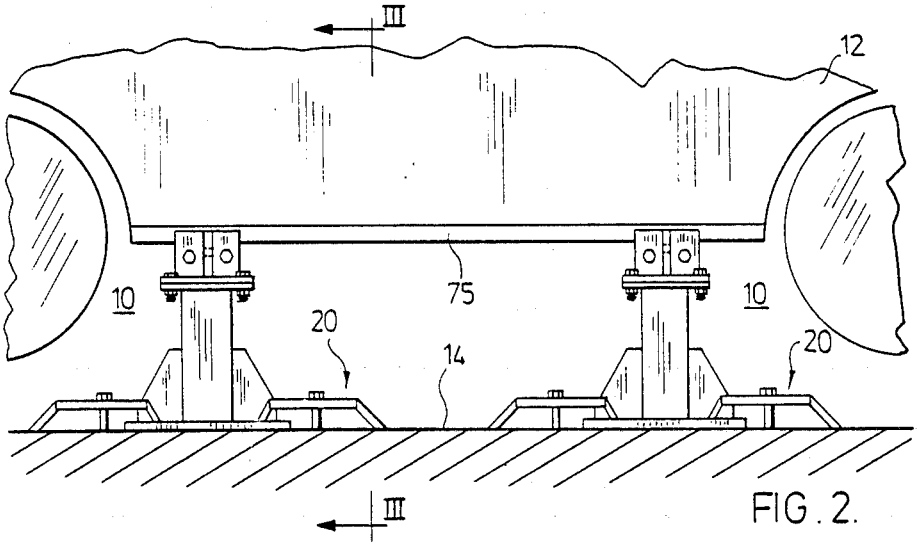
FIG. 2 is a side plan view of the anchoring system of FIG. 1, showing the use of two clamps to positively anchor the support stand.
Figure 3:
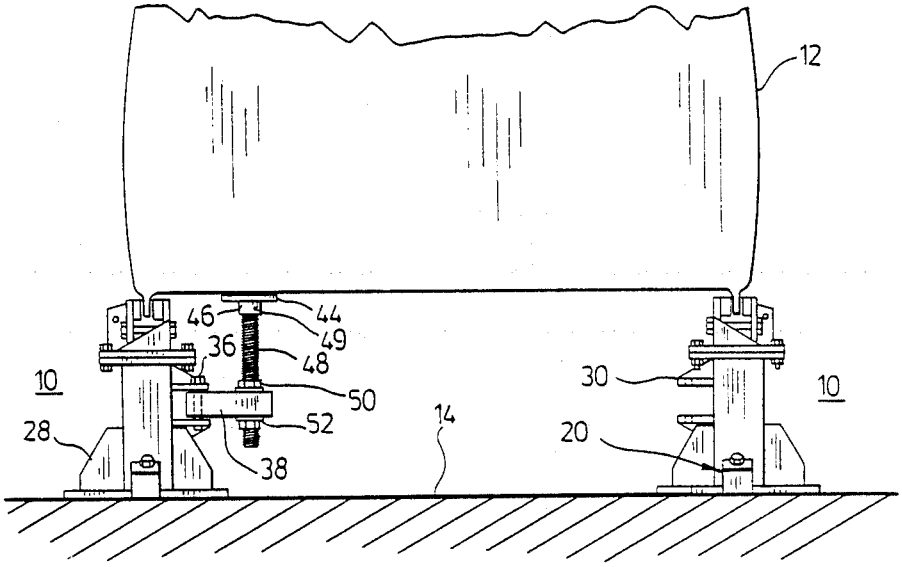
FIG. 3 is a sectional view taken along lines III—III of FIG. 2 showing the anchoring system.

Referring to the drawings, the preferred embodiments of the present invention are described.

Referring to FIGS. 1 through 7, the anchoring system of the present invention is illustrated. The anchoring system comprises four anchoring apparatus 10 for supporting an automobile 12 with respect to a base or concrete floor 14. It should be understood that the base may alternatively be a rail or rack system. The anchoring system positively anchors the automobile 12 relative to the concrete floor 14.

Each anchoring apparatus includes a stand means 16, including a vehicle securing means 18, and stand securing means 20. The stand means or stand 16 includes a rectangular base member 22 which is adapted to lie flush with the surface of concrete floor 14. The base plate 22 has upper flat surface portions against which stand securing means 20 may be clamped. The stand 16 further includes a rectangular tubular support member 24 upstanding from the base plate 22. The support member 24 and base member 22 comprise steel material and are welded together at the join 26. As illustrated, the support member 24 covers a portion of the upper surface area of the base plate 22 and a plurality of rigid support legs or gussets 28 interconnect the support member 24 and base plate member 22 such that forces acting on the upper portion of support member 24 are dispersed over the base member 22.

The support stand 16 further includes two opposed flanges 30 and reinforcing gussets 32 interconnecting each flange 30 with the stand 16. Flanges 30 are provided with aligned apertures 34 through which a pin 36 passes. An arm support means 38 is insertable between the flanges 30 and pivotally connected relative to the support stand 24 by means of the pin 36 passing through the slotted aperture 40 in the arm support means 38. The arm support means is provided with a body support means 42 comprising a flat pad 44 having boss 46 for receiving stem 48. As illustrated in FIGS. 5 and 5A, the pad 44 is pivotally connected by bolt 49 to stem 48 such that the pad can engage surfaces of the underside of the automobile 12 which are not parallel with the concrete floor 14. The pad 44 is able to pivot about 15 degrees from the horizontal. Further, because the stem 48 can be rotated, the pad 44 can pivotally move in all directions about stem 48. Nuts 50 and washers 52 are privided to adjust and secure the position of the stem 48 whereby the stem 48 and the pad 44 can be moved horizontally along slot 40 and can be jacked vertically of arm means 34 until pad 44 engages the underside of the vehicle. Alternatively, the body support means 42 may comprise a bracket for receiving a large elongated piece of wood such as a 2" by 4" beam whereby the beam may pass completely under the vehicle and be secured to another bracket attached to another support apparatus on the other side of the vehicle whereby the 2" by 4" can be jacked up into engagement with the underside of the vehicle.

Figure 6:
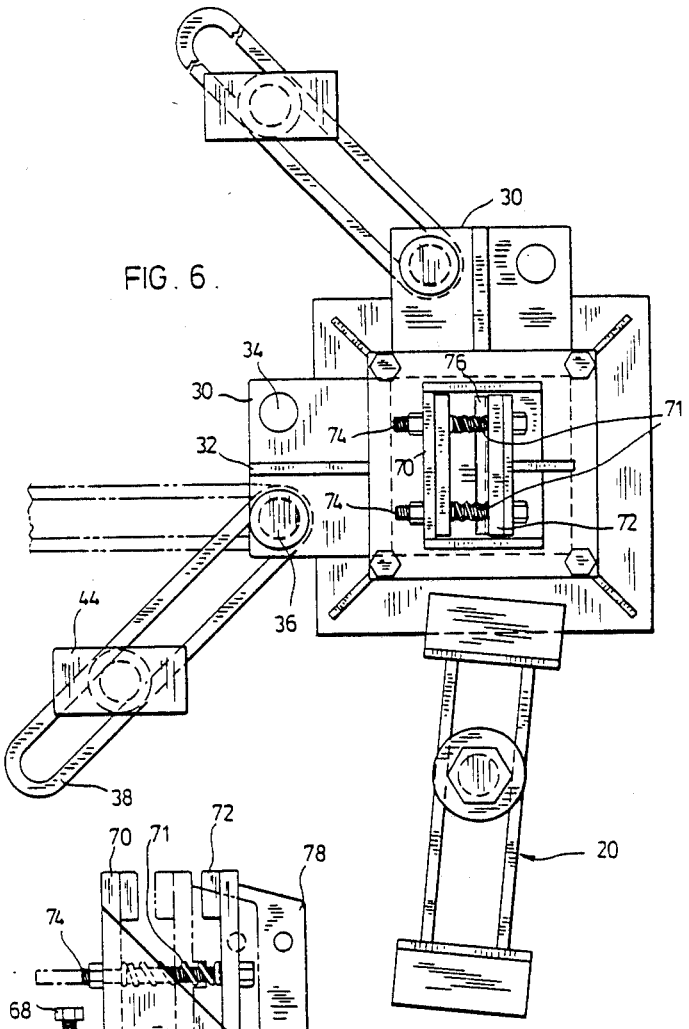
FIG. 6 is a top plan view of the anchoring apparatus of the present invention showing that more than one support arm means can be attached to the stand means.
Figure 7:
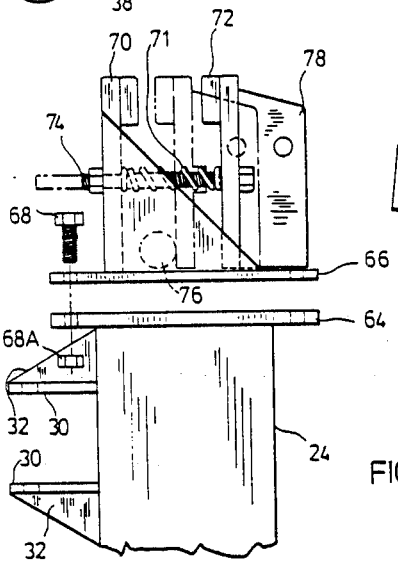
FIG. 7 is a top side view of the upper portion of the anchoring apparatus of the present invention showing the movement of the clamping jaws.
Figure 8:
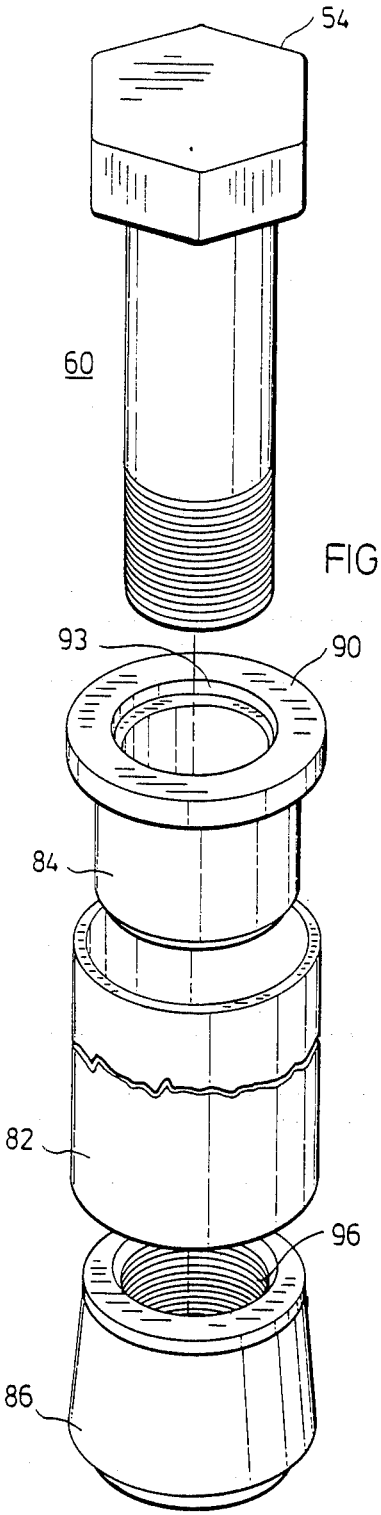
FIG. 8 is an exploded perspective view of a portion of the anchoring device of the present invention.
Figure 9:
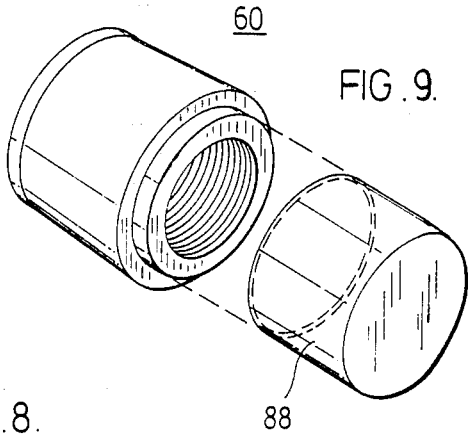
FIG. 9 is an exploded perspective view of the remaining portion of the anchoring device of the present invention.

As shown in FIG. 6, more than one set of flanges 30 and arm support means 38 may be secured to a stand 24. In the preferred embodiment of this Figure, from the ghost lines of one of the arm means 34 it is evident that the arm means 34 can pivot more than 90 degrees with respect to each of the set of apertures 34 of flanges 30. Thus, it is possible to adapt the stand 16 to permit the arm means 34 to be inserted into various sets of apertures 34 to allow the arm means to be positioned in any direction around the stand 16.

Each of the stand securing means comprises an anchoring means or bolt 54, a washer 56, a clamp 58 and an anchoring device 60. It should be understood that the anchoring device may alternatively comprise another nut and washer on the underside of a rail so as to positively locate the clamp relative to the rail. In the practice of the present invention, the bolt and washer can slide along the slot 60 of the clamp 58 so as to provide for some relative movement of the clamp 60 with respect to the concrete 14 and the position of the stand 24. This allows some freedom in the initial positioning of stand 24. The bolt 54 when tightened draws washer 56 down upon clamp 58 causing the slanted end plates 62 of the clamp 58 to be drawn against the upper surface portion of base plate member 22 and the floor 14. The end plates 62 are slanted to enhance the clamp down effect. One end plate 62 is smaller than the other to compensate for the height of base member 22. This allows the clamp 58 to maintain bolt 54 at right angles thereto. Two or more clamps are provided so as to positively anchor the stand 16 with respect to the concrete floor 14.

Releasibly secured to the upper portion of the stand 16 is the vehicle securing means 18. The upper portion of the stand 16 is provided with a top support plate 64 which has apertures aligned therein with the apertures of flange plate 66 of vehicle securing means 18. Bolts 68 and nuts 68A secure the vehicle securing means 18 to the upper portion of the stand 24. The vehicle securing means comprises a first stationary jaw 70 and a second jaw 72 movable towards jaw 70 by tightening bolts 74 so as to grasp pinchwelds 75 of the vehicle. Coiled springs 71 surround bolts 74 between jaws 70, 72 so as to bias movable jaw 72 into an open position and thereby facilitate insertion of pinchweld 75 between jaws 70, 72. As can be seen in FIG. 6, a runner bar 76 is attached to the movable jaw 72 so that when the jaws are drawn together bar 76 provides a pivot for the jaws allowing the clamping pressure to be applied to the mouths of the jaws to grasp the pinchweld. A flange 78 having an aperture therein is provided on the back plate of jaw 72 to allow a hook to be inserted in the aperture of flange 78 and permit the stand 16 to be used in the pulling operation should it be necessary to straighten the pinchwelds of the vehicle prior to effecting the other structural repair to the vehicle.

In operation, a vehicle to be repaired is positioned above the concrete floor 14. One side of the vehicle is jacked up and two anchoring apparatus 10 are inserted under the vehicle. The vehicle is then jacked down until such time as the pinchwelds are positioned between the jaws 70, 72 of the two apparatus. The jaws of the two apparatus are then tightened to secure the two apparatus relative to the automobile 12. Each apparatus is then secured to the floor by two clamps 58 and bolts 54 secured in anchoring devices 60 in floor 14. Next the other side of the vehicle is jacked up and the similar procedure with two anchoring apparatus is undergone until such time as the vehicle 12 is supported by four or more support apparatus 10. At this time the vehicle is positively located by the anchoring apparatus 10. By positively anchoring the vehicle with respect to the floor, the vehicle does not move when it is being repaired. Thus, the points of reference for the vehicle are set and a gauging system used to measure the repair of the vehicle maintains its accuracy. When the pulling towers are set up to effect the repair of the damaged structure of the automobile 12, arms 38 and body support members 42 may be adjusted such that the arms are in alignment with the direction of the pull to disperse loading forces over the stand.

Referring now to FIGS. 1 and 8–12 there is illustrated an anchoring device of the preferred embodiment which can be secured within a concrete floor.

The anchoring device 60 includes an aluminum cylindrical means 82, a stell reinforcing collar 84, a steel securing means 86, and a plastic cap 88. The spacing between the cylinder means 82 and aperture 104 of the concrete is exaggerated in FIGS. 10, 11 and 12.

The reinforcing collar 84 is fitted into cylinder 82 and has an upper surface 90 which is adapted to lie flush with the concrete floor 14. The bushing is provided with seating portions 92 which receive another plastic cap 93 so as to cover the aperture 94 of the bushing when the anchoring device is not in use. The collar 84 has an inner wall 81 which defines the collar aperture 94. The inner wall 81 is of a predetermined height so as to disperse components of loading forces acting on the bolt 54 in directions perpendicular to the axis 93 of the cylinder 82. The inner walls 91 limit movement of bolt 54 in these directions. Anchoring means or bolt 54 passes through the aperture 94 and the inside of the cylinder 82 and threadably engages with threaded aperture 96 of the securing means or piston 86 (FIG. 12). Piston 86 limits movement of bolt 54 along axis 93 of the cylinder 82. The piston 86 is provided with a flange 98 on its outside portion to which cap 88 is fitted. Cap 88 prevents water from seeping up through aperture 96 and into the cavity of the cylinder 82. The piston is provided with a portion 100 which is insertable into the lower open end of the cylinder 82 and is further provided with a conically shaped continuous diverging portion 102. The diverging portion 102 has an increasing outside dimension which is greater than the lower opening of the cylinder 82 and is no greater than the outside dimension of the cylinder 82. This allows the anchoring device to be inserted into the aperture 194 in the concrete floor 14. As the bolt 54 is threadably secured in the piston 86, the clamp 58 is secured relative to the floor 14 and the support stand 24. Also, the piston 86 is drawn up into the cylinder 82 causing the walls of the cylinder to be displaced into engagement with the concrete 14. The cylinder walls are deformable causing the cylinder walls to fill any small irregularities in the concrete as shown in FIG. 12 at 103.

Figure 10:
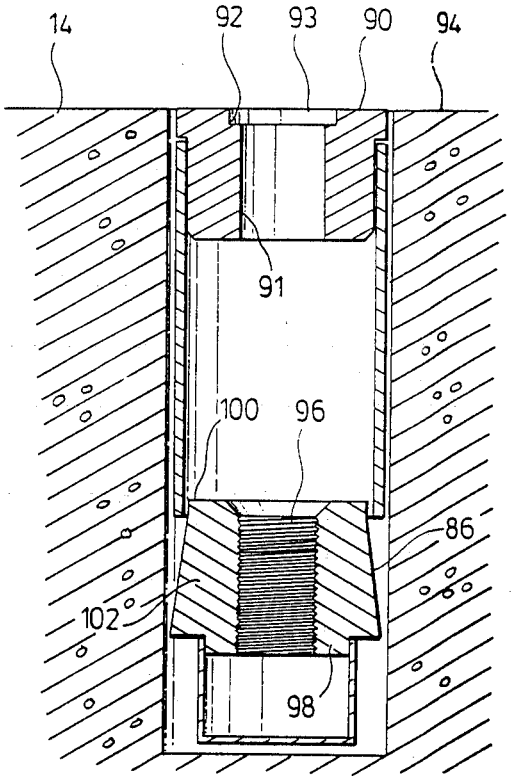
FIG. 10 is a sectional view showing the anchoring device of the present invention inserted into an aperture in the concrete floor ready for installation.

Referring to FIG. 10, the anchoring device 60 is illustrated as being inserted into the aperture 104 of concrete floor. In FIG. 11, the anchoring device is about to be installed in the floor 14. A torquing bolt 106, a sleeve 108 and a washer 110 are used to install the anchoring device 60. Bolt 106 is threaded into piston 86. Torque is then applied to the head of bolt 106 by suitable means to draw piston 86 upward. As piston 86 is drawn upward, it tends to drive the cylinder 82 out of the floor. Collar 84 is held down by sleeve 108, however, and as a result the collar is pressed into cylinder 82 and the piston is drawn up into cylinder 82 causing the walls of the cylinder to be displaced into engagement with the concrete as shown in FIG. 12. It is this displacement of the walls of the cylinder into engagement with the floor that anchors the anchoring device in the floor for future applications.

FIG. 12 illustrates the anchoring device 60 when in use with bolt 54, washer 56 and clamp 58 of the anchoring apparatus 10. In use the anchoring device positively anchors the bolt 54 to the floor 14. Forces pulling on the bolt 54 are dispersed to the concrete floor through the anchoring device. Horizontal force components are dispersed through the piston to the walls of the cylinder. As the horizontal forces increase the piston can further displace the cylinder walls to increase the anchoring strength of the anchoring device if these increasing forces exceed the force applied to the anchoring device during its installation. The vertical force components are dispersed through the collar to the concrete floor reducing the risk of the bolt shearing along its shank.

The diverging means of the piston has been illustrated in the preferred embodiment as being continuous. It should be understood that the diverging means may be provided with grooves or comprise spaced apart wing members. In other words, the diverging means may only displace portions of the cylinder wall into engagement with the floor.

The embodiments of the invention in which an exclusive property or privilege is claimed are defined as follows:

1. An anchoring apparatus for use in a vehicle anchoring system to positively anchor a vehicle with respect to a base, said apparatus including:

rigid stand means having a base member adapted to engage said base for dispersing loading forces thereto and a support member upstanding a predetermined distance from said base member, said stand means including vehicle securing means positioned on the upper end of said support member and releasably securable with said vehicle for securing said vehicle to said stand means;

stand securing means securable with the base member of said stand means and said base to positively anchor said stand means on said base whereby said stand means does not move and arm support means movably connectable with said support member and extending outwardly of said support member to support the underside of said vehicle to disperse the load of said vehicle.

2. An apparatus according to claim 1 wherein said vehicle securing means includes means for receiving pulling means whereby said apparatus can be used to repair the vehicle prior to being positively anchored to said base.

3. An apparatus according to claim 1 wherein said stand securing means is releasibly securable with said stand means.

4. An apparatus according to claim 3 wherein said stand securing means includes a clamp bracket having an elongated slot through which an anchoring means may be drawn to clamp an end of the bracket to each of the base member and base.

5. An apparatus according to claim 4 wherein one end of said bracket is smaller than the other end to compensate for the height of the base member so as to maintain the clamp bracket perpendicular to the axis of the anchoring means.

6. An apparatus according to claim 1 wherein said vehicle securing means is releasibly securable with said stand means.

7. An apparatus according to claim 6 wherein said vehicle securing means comprises at least two opposing jaws, one being movable relative to the other to grasp the pinchweld of the vehicle.

8. An apparatus according to claim 1 wherein said arm support means includes a body support means securable therewith and to said vehicle to support the underside of said vehicle.

9. The apparatus according to claim 8 wherein said arm support means includes an elongated slotted arm having one end thereof pivotally connected to said support member of said stand means and said body support means comprises a support pad mounted to a stem, said stem being slidable horizontally along the arm slot, securable in the arm slot and adjustable vertically relative to the arm to bring the pad into engagement with said vehicle.

10. An apparatus according to claim 9 wherein said pad is pivotally mounted to said stem.

11. An apparatus according to claim 1 wherein said support member is a rectangular tube and at least one side thereof is provided with a bracket for receiving said arm support means.

12. An apparatus according to claim 11 wherein said bracket comprises two spaced apart flange plates welded to said support member, said arm support means being pivotally connectable to said flange plates with an end thereof insertable between said flange plates, and a pin passing through aligned apertures in said flange plates and arm support means to connect the flange plates and arm support means.

13. An apparatus according to claim 12 wherein a gusset is welded along an outer surface of each said flange plate and said support member.

14. An apparatus according to claim 11 wherein the upper end of said support member has an upper support plate provided with apertures through which bolts may pass to secure the stand means with the vehicle securing means.

15. An apparatus according to claim 1 wherein a plurality of rigid support legs interconnect said support member and said base plate member to disperse forces acting upon the upper end of said support member to said base plate member.

16. An apparatus according to claim 15 wherein said rigid support legs are gussets having one side edge welded to said base plate member and another side edge welded to said support member.

17. An anchoring system for positively anchoring a vehicle with respect to a base, said system including at least three anchoring apparatus as claimed in claim 1, said apparatus being arranged underneath said vehicle to disperse the load of the vehicle evenly thereon.

18. An anchoring system as claimed in claim 17 wherein one or more of said apparatus are used to repair said vehicle prior to being secured to said base.

* * * * *

UNITED STATES PATENT AND TRADEMARK OFFICE

CERTIFICATE OF CORRECTION

PATENT NO. : 4,585,198

DATED : April 29, 1986

INVENTOR(S) : Guy Norman Chartier, et al

It is certified that error appears in the above-identified patent and that said Letters Patent is hereby corrected as shown below:

Column 2, line 7, "devide" should read --device--.

Column 3, line 19, "advantagrous" should read --advantageous--.

Column 3, line 39, "connectably" should read --connectable--.

Column 5, line 6, "join 26." should read --joint 26.--.

Column 5, line 19, "support stand 24" should read --support member 24--.

Column 5, line 30, "privided" should read --provided--.

Column 5, line 44, "stand 24" should read --stand 16--.

Column 6, line 7, "Releasibly" should read --Releasably--.

Column 6, line 60, "stell" should read --steel--.

Column 7, line 2, "inner wall 81" should read --inner wall 91--.

UNITED STATES PATENT AND TRADEMARK OFFICE

CERTIFICATE OF CORRECTION

PATENT NO. : 4,585,198 Sheet 2 of 2

DATED : April 29, 1986

INVENTOR(S) : Guy Norman Chartier, et al

It is certified that error appears in the above-identified patent and that said Letters Patent is hereby corrected as shown below:

Column 7, line 3, "inner wall 81" should read --inner wall 91--.

Column 8, line 31, "releasibly" should read --releasably--.

Column 8, line 44, "releasibly" should read --releasably--.

Signed and Sealed this

Twenty-ninth Day of December, 1987

*Attest:*

DONALD J. QUIGG

*Attesting Officer*

*Commissioner of Patents and Trademarks*